United States Patent [19]

Tanizaki et al.

[11] 3,966,625

[45] June 29, 1976

[54] LUBRICATING OIL COMPOSITION CONTAINING POLYOXYALKYLENE GLYCOL DIETHER VISCOSITY-INDEX IMPROVERS

[75] Inventors: Yoshiharu Tanizaki, Kamakura; Hiroshi Kawaguchi, Tokyo; Kenichiro Minagawa, Kawasaki, all of Japan

[73] Assignee: Nippon Oils and Fats Company Limited, Tokyo, Japan

[22] Filed: Oct. 3, 1974

[21] Appl. No.: 511,525

Related U.S. Application Data

[63] Continuation of Ser. No. 290,272, Sept. 18, 1972, abandoned.

[30] Foreign Application Priority Data

Sept. 23, 1971 Japan ..... 46-74405

[52] U.S. Cl. ..... 252/52 A; 252/52 R

[51] Int. Cl.[2] ..... C10M 1/20

[58] Field of Search ..... 252/52 A, 52 R, 73; 260/615 A

[56] References Cited

UNITED STATES PATENTS

| | | | |
|---|---|---|---|
| 2,796,423 | 6/1957 | Cottle et al. | 252/52 A X |
| 2,813,129 | 11/1957 | Benoit | 252/52 A X |
| 3,189,586 | 6/1965 | Stuart et al. | 252/52 A X |
| 3,324,035 | 6/1967 | Nankee et al. | 252/73 |
| 3,329,614 | 7/1967 | Milnes et al. | 252/73 |
| 3,329,725 | 7/1967 | Lederle | 252/73 |
| 3,498,921 | 3/1970 | Edwards et al. | 252/73 |
| 3,563,893 | 2/1971 | Doelling et al. | 252/73 |
| 3,856,691 | 12/1974 | Haugen et al. | 252/52 R |

*Primary Examiner*—Delbert E. Gantz
*Assistant Examiner*—Andrew H. Metz
*Attorney, Agent, or Firm*—Stevens, Davis, Miller & Mosher

[57] ABSTRACT

Polyoxyalkylene glycol diethers having the general formula $$[RO-(CH_2-\overset{CH_3}{\overset{|}{C}}HO)_a(CH_2-\overset{C_2H_5}{\overset{|}{C}}HO)_b(\overset{CH_3}{\overset{|}{C}}H-\overset{CH_3}{\overset{|}{C}}HO)_c]_2CH_2$$

are a good viscosity index improver having a high solubility in a mineral oil and an excellent shear stability. This invention relates to a lubricating oil composition consisting essentially of a mineral oil and the above described polyoxyalkylene glycol diether.

2 Claims, No Drawings

LUBRICATING OIL COMPOSITION CONTAINING POLYOXYALKYLENE GLYCOL DIETHER VISCOSITY-INDEX IMPROVERS

This is a continuation of application Ser. No. 290,272, filed Sept. 18, 1972, now abandoned.

The present invention relates to lubricating oil compositions having a very high viscosity index.

In general, mineral oils are poor in the viscosity characteristics and the viscosity index is low, therefore the viscosity varies considerably due to difference of temperature.

Heretofore, as the viscosity index improver, polymethacrylate has been added to mineral oils but said polymethacrylate is generally poor in the shear stability and when it is used under the condition where the shear stress occurs, the molecular breakage occurs and the viscosity lowers with the passage of time. Polybutene also has been used and it is good in the shear stability, although the improvement of the viscosity index is poor, therefore it is often used as a viscosity improving agent. Polystyrene and polyfumarate have been known as a viscosity index improver but are not usual.

The present invention consists in a lubricating oil composition in which a polyoxyalkylene glycol diether having the general formula

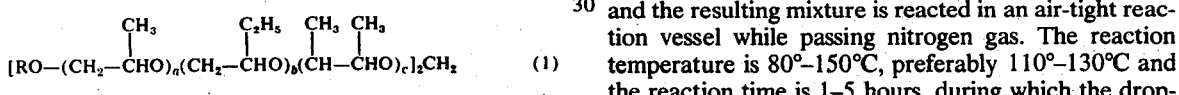

$$[RO-(CH_2-\overset{CH_3}{\overset{|}{C}}HO)_a(CH_2-\overset{C_2H_5}{\overset{|}{C}}HO)_b(\overset{CH_3}{\overset{|}{C}}H-\overset{CH_3}{\overset{|}{C}}HO)_c]_2CH_2 \quad (1)$$

wherein R is a hydrocarbon radical shown by the general formula: $C_nH_{2n+1}$, $C_nH_{2n-1}$, $C_nH_{2n-3}$ or $C_nH_{2n-5}$, $n$ an integer of 1–24, $$K = \frac{b+c}{a+b+c}, N \geqq 6-5K$$

$a+b+c$ is an integer of 5–100 and $a$ or $b+c$ may be 0 but $a$, $b$, and $c$ are not 0 at the same time, is admixed to a mineral oil.

The above described polyoxyalkylene glycol diethers are novel compounds.

The mineral oils may be naphthene, paraffin or aromatic lubricating oils and are preferred to have a SAE viscosity number of less than 50 and a viscosity index of less than 120. The effect for improving the viscosity index is larger against the mineral oil having a lower viscosity and a lower viscosity index.

The above described polyoxyalkylene glycol diethers are added to the mineral oils in an amount of 2–50% by weight based on the mineral oils and in the case of an amount of less than 2% by weight, the effect for improving the viscosity index is lower, while even if an amount of more than 50% by weight is added, the addition effect does not increase.

The solubility of the polyoxyalkylene glycol diethers in the mineral oils is very good, and the carbon atom number in the hydrocarbon radical of R is an integer of 1–24 and $a+b+c$ is an addition mole number of alkylene oxides. The smaller said addition mole number, the larger $n$, and the larger the value of K, that is, the larger the addition mole ratio of butylene oxide to propylene oxide, the better the solubility to the mineral oils is.

Then an explanation will be made with respect to the production of the above described polyoxyalkylene glycol diethers.

An alcohol of ROH, for example, methanol, ethanol, allyl alcohol, propanol, butanol, amyl alcohol, hexanol, heptanol, octanol, nonanol, decanol; fatty alcohols obtained by reduction of fatty acids or from animal or vegetable fats and oils, such as lauryl alcohol, myristyl alcohol, cetyl alcohol, stearyl alcohol, oleyl alcohol, linoenyl alcohol, linoleyl alcohol, and the like; synthetic alcohols obtained by Ziegler process, oxo process or oxidation of paraffin, is subjected to a random polymerization or a block polymerization with at least one of propylene oxide (PO) and butylene oxide (BO), in the presence of an alkali catalyst to obtain polyoxyalkylene glycol monoethers (abbreviated as PAGME).

To PAGME is added 1.0–1.4 mole, preferably 1.05–1.15 mole based on 1 mole of OH in PAGME, of metallic sodium or sodium methoxide and the resulting mixture is reacted at a high temperature to convert the terminal OH group of PAGME into —ONa. In the case when sodium methoxide is used, the reaction is effected at a temperature of 80°–150°C, preferably 110°–120°C in gaseous nitrogen under a reduced pressure of lower than 20 mmHg for 2 to 5 hours.

Then, to the reaction mixture is added dropwise 0.5–0.70 mole, preferably 0.52–0.60 mole of dihalomethanes ($CH_2X_2$), such as dichloromethane ($CH_2Cl_2$), dibromomethane ($CH_2Br_2$) or diiodomethane ($CH_2I_2$) and the resulting mixture is reacted in an air-tight reaction vessel while passing nitrogen gas. The reaction temperature is 80°–150°C, preferably 110°–130°C and the reaction time is 1–5 hours, during which the dropwise addition is continued and then the reaction mixture is aged at the same temperature as described above for 2 hours. By filtering sodium halide of a byproduct in the resulting PAGME or washing said sodium halide with a solvent and water, polyoxyalkylene glycol diether (PAGDE) is obtained.

This reaction is shown by the following formulae

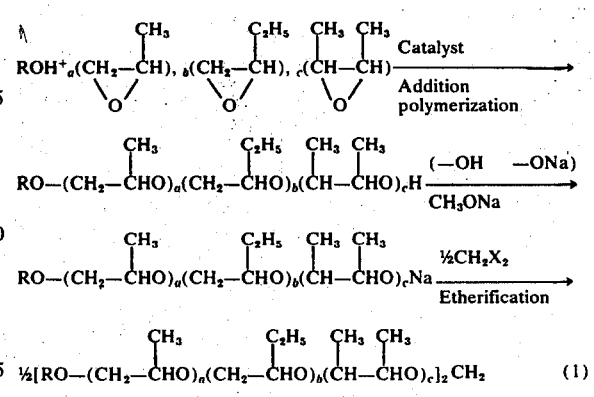

$$\frac{1}{2}[RO-(CH_2-\overset{CH_3}{\overset{|}{C}}HO)_a(CH_2-\overset{C_2H_5}{\overset{|}{C}}HO)_b(\overset{CH_3}{\overset{|}{C}}H-\overset{CH_3}{\overset{|}{C}}HO)_c]_2CH_2 \quad (1)$$

The reactivity of the above described etherification by means of dihalomethane ($CH_2X_2$) is high and the percentage of the etherification reaction is about 90%.

PAGDE has a good solubility to mineral oils and an excellent shear stability and is suitable for a viscosity index improver.

As the synthetic lubricants, mention may be made of polyethers which are derivatives of ethylene oxide and propylene oxide, such as polyoxyethylene glycol, polyoxyethylene-propylene glycol, polyoxypropylene glycol or monoalkyl ethers or monoalkenyl ethers thereof but they are very poor in the compatibility with mineral oils and are not suitable for the viscosity index improver for mineral oils.

Of course, the lubricating oil compositions according to the present invention generally contains the other usual additives for the lubricants, for example, conventional antioxidants, extreme pressure agents, corrosion inhibitors, antiwear agents and the like.

The production of the PAGDE of the present invention will be explained in more detail with reference to the following production examples. However, the production examples are not limitative. In the production examples, "part" means part by weight.

Production Example 1 n-Hexanol was introduced into an air-tight reaction vessel. PO was then introduced forcedly into the reaction vessel and an addition polymerization reaction was effected at 110° to 140°C in the presence of an alkali catalyst in gaseous nitrogen to obtain polyoxypropylene glycol monohexyl ether (hereinafter abbreviated as PPGMHE) (Compound No. 1), having an OH value of 70.1 and an average molecular weight (hereinafter abridged as MW) of 801.

To a part of the PPGMHE containing the alkali catalyst was additionally introduced PO forcedly, and an addition polymerization was effected to obtain PPGMHE-1 (Compound No. 2) having an OH value of 36.3 and a MW of 1,550.

To 100 parts (0.12 mole) of the above obtained PPGMHE was added 7.4 parts (0.13 mole) of sodium methoxide, and the resulting mixture was reacted at 120° to 130°C for 4 hours under a reduced pressure of 20 mmHg in gaseous nitrogen to convert the end —OH group to —ONa. Then, 5.6 parts (0.066 mole) of dichloromethane was added forcedly into the reaction mixture at 120° to 140°C in 3 hours, and the resulting mixture was aged for 2 hours at the same temperature to obtain 96 parts of crude PPGDHE. To 95 parts of the PPGDHE was added 95 parts of toluene and the resulting mixture was washed with 150 parts of hot water to remove the resulting salt. After the toluene was removed at 110°C under a reduced pressure, the residue was filtered to obtain 94 parts of an aimed product, PPGDHE (Compound No. 3) having an OH value of 4.6. The percentage of the etherification reaction was 93%.

In the same manner as described above, 4.0 parts (0.074 mole) of $CH_3ONa$ and 3.0 parts (0.035 mole) of $CH_2Cl_2$ were added to 100 parts of the above obtained PPGMHE-1, and an etherification reaction of the PPGMHE-1 was effected, and then the resulting mass was purified to obtain 95 parts of PPGDHE-1 (Compound No. 4) having an OH value of 4.2. The percentage of the etherification reaction was 88%.

Production Example 2

Under the same conditions as described in Production Example 1, a mixed alcohol of $C_{12}$-alcohol and $C_{14}$-alcohol ($C_{12}$:$C_{14}$=1:1) was charged into a reaction vessel, and an addition polymerization of PO to the mixed alcohol was effected to obtain PPGMAE (Compound No. 5), wherein A represents alkyl radical, having an OH value of 35.0 and a MW of 1,600. To 100 parts (0.062 mole) of the PPGMAE were added 3.7 parts (0.069 mole) of $CH_3ONa$ and 2.9 parts (0.034 mole) of $CH_2Cl_2$, and an etherification reaction of the PPGMAE was effected, and the resulting mass was purified to obtain 96 parts of PPGDAE (Compound No. 6) having an OH value of 5.1. The percentage of the etherification reaction was 85%.

Production Example 3

In the same manner as described in Production Example 1, a mixture of PO and BO (a mixture of 1,2-BO and 2,3-BO in a ratio of 80:20) in a ratio of PO:BO=75:25 was introduced forcedly into lauryl alcohol, and an addition polymerization of the PO and BO to the lauryl alcohol was effected to obtain PPBGMLE (Compound No. 7), wherein L represents lauryl radical, having an OH value of 35.5 and a MW of 580. To 100 parts (0.063 mole) of the PPBGMLE were added 3.7 parts (0.069 mole) of $CH_3ONa$ and 2.9 parts (0.034 mole) of $CH_2Cl_2$, and the PPBGMLE was etherified, and the resulting mass was purified to obtain 96 parts of PPBGDLE (Compound No. 8) having an OH value of 4.9. The percentage of the etherification reaction was 86%.

Production Example 4

In the same manner as described in Production Example 1, an addition polymerization of PO to n-butanol was effected to obtain PPGMBE having an OH value of 70.1 and a MW of 799.

A block addition polymerization of BO to the above obtained PPGMBE was effected to obtain PPBGMBE (Compound No. 9) having an OH value of 33.0 and a MW of 1,700. The molar ratio of PO:BO in this addition polymerization was 1:1.

To 100 parts (0.059 mole) of the PPBGMBE were added 3.5 parts (0.065 mole) of $CH_3ONa$ and 2.7 parts (0.032 mole) of $CH_2Cl_2$, and the PPBGMBE was etherified and the resulting mass was purified to obtain 97 parts of PPBGDBE (Compound No. 10) having an OH value of 4.7. The percentage of the etherification reaction was 86%.

Production Example 5

Under the same condition as described in Production Example 1 an addition polymerization of BO as used in Production Example 3 to methanol was effected to obtain PBGMmE (Compound No. 11), wherein *m* represents methyl radical, having an OH value of 38.0 and a MW of 1,480.

To a part of the PBGMmE, an additional amount of the BO was polymerized to obtain PBGMmE-1 (Compound No. 12) having an OH value of 22.9 and a MW of 2,450.

100 parts (0.068 mole) of the PBGMmE was etherified by using 4.0 parts (0.074 mole) of $CH_3ONa$ and 3.2 parts (0.038 mole) of $CH_2Cl_2$ and the resulting mass was purified to obtain 96 parts of PBGDmE (Compound No. 13) having an OH value of 4.3. The percentage of the etherification reaction was 86%.

Further, 100 parts (0.041 mole) of the PBGMmE-1 was etherified by using 2.4 parts (0.045 mole) of $CH_3ONa$ and 1.95 parts (0.023 mole) of $CH_2Cl_2$, and the resulting mass was purified to obtain 94 parts of PBGDmE-1 (Compound No. 14) having an OH value of 3.0. The percentage of the etherification reaction was 87%.

Compositions and properties of the compounds obtained in the above Production Examples are shown in the following Tables 1 and 2.

Table 1

| Compound No. | Production Example No. | Compound | Type | Polymerization ratio PO | BO | $K = \frac{b+c}{a+b+c}$ | Polymerization degree $a+b+c$ |
|---|---|---|---|---|---|---|---|
| 1 | 1 | PPGMHE | mono | 100 | 0 | 0 | $a = 12$ |
| 2 | 1 | PPGMHE-1 | mono | 100 | 0 | 0 | $a = 25$ |
| 3 | 1 | PPGDHE | di | 100 | 0 | 0 | $a = 12$ |
| 4 | 1 | PPGDHE-1 | di | 100 | 0 | 0 | $a = 25$ |
| 5 | 2 | PPGMAE | mono | 100 | 0 | 0 | $a = 24$ |
| 6 | 2 | PPGDAE | di | 100 | 0 | 0 | $a = 24$ |
| 7 | 3 | PPBGMLE | mono | 75. | 25 | 0.25 | $a = 17$ $b+c = 5.7$ |
| 8 | 3 | PPBGDLE | di | 75 | 25 | 0.25 | $a = 17$ $b+c = 5.7$ |
| 9 | 4 | PPBGMBE | mono | 50 | 50 | 0.50 | $a = 12.5$ $b+c = 12.5$ |
| 10 | 4 | PPBGDBE | di | 50 | 50 | 0.50 | $a = 12.5$ $b+c = 12.5$ |
| 11 | 5 | PBGMmE | mono | 0 | 100 | 1 | $b+c = 25$ |
| 12 | 5 | PBGMmE-1 | mono | 0 | 100 | 1 | $b+c = 42$ |
| 13 | 5 | PBGDmE | di | 0 | 100 | 1 | $b+c = 25$ |
| 14 | 5 | PBGDmE-1 | di | 0 | 100 | 1 | $b+c = 42$ |

Table 2

| Compound No. | Production Example No. | Polymerization type | Average molecular weight | OH value | Viscosity (cst) 210°F | 100°F | Viscosity index (VI) |
|---|---|---|---|---|---|---|---|
| 1 | 1 | Homo | 801 | 70.1 | 8.03 | 42.3 | 148.0 |
| 2 | 1 | " | 1,550 | 36.3 | 24.1 | 153.6 | 140.0 |
| 3 | 1 | " | 1,650 | 4.6 | 15.2 | 83.1 | 147.5 |
| 4 | 1 | " | 3,150 | 4.2 | 44.4 | 286.4 | 135.5 |
| 5 | 2 | " | 1,600 | 35.0 | 26.6 | 172.3 | 139.0 |
| 6 | 2 | " | 3,250 | 5.1 | 50.2 | 338.0 | 134.0 |
| 7 | 3 | Random | 1,580 | 35.5 | 25.3 | 178.6 | 136.5 |
| 8 | 3 | " | 3,210 | 4.9 | 49.8 | 355.1 | 133.0 |
| 9 | 4 | Block | 1,700 | 33.0 | 27.1 | 194.9 | 135.5 |
| 10 | 4 | " | 3,450 | 4.7 | 57.9 | 443.1 | 131.0 |
| 11 | 5 | Homo | 1,480 | 38.0 | 26.8 | 238.9 | 127.0 |
| 12 | 5 | " | 2,450 | 22.9 | 51.7 | 513.4 | 126.0 |
| 13 | 5 | " | 3,010 | 4.3 | 57.4 | 558.9 | 126.5 |
| 14 | 5 | " | 4,950 | 3.0 | 115.3 | 931.2 | 125.5 |

The viscosity index (VI) was calculated according to JIS K-2284-1961 (JIS K-2284-1969, "A" process).

The following examples are given in illustration of this invention and are not intended as limitations thereof. In the examples, "%" means % by weight.

Example 1

The Compounds No. 1 to No. 14 obtained in the above Production Examples 1 to 5 were added to Mineral oils A to C having the properties as shown in the following Table 3, and the solubility of the compounds was tested.

Table 3

| Property | | Mineral oil A | B | C |
|---|---|---|---|---|
| Viscosity (cst) | 210°F | 3.01 | 5.13 | 14.7 |
| | 100°F | 13.8 | 30.3 | 284.1 |
| Viscosity index | (VI) | 71.5 | 108.5 | 21.5 |
| Refractive index | ($n_D^{20}$) | 1.4749 | 1.4815 | 1.5236 |

Table 3-continued

| Property | | Mineral oil A | B | C |
|---|---|---|---|---|
| Specific gravity | ($d_4^{20}$) | 0.8640 | 0.8749 | 0.9445 |
| Molecular weight | (M) | 310 | 405 | 430 |
| Sulfur | (%) | 0.05 | 0.10 | 0.08 |

The molecular weight M was measured according to ASTM-D2502-67.

Table 4 shows solubilities of the compounds obtained in the above production examples in the mineral oils. The solubility was measured as follows. A compound to be tested is added in an amount of 10–50% by weight to a mineral oil, and the resulting composition is stirred at a given temperature and then left to stand to determine the lowest temperature (°C) at which the composition does not yet cause the separation. The lower the lowest temperature, the more excellent the solubility.

Table 4

| Test No. | Production Example No. | Compound No. | Mineral oil | Solubility (°C), Addition amount (%) 10% | 20% | 30% | 40% | 50% |
|---|---|---|---|---|---|---|---|---|
| 15 | 1 | 1 | A | 15°C | 16°C | 17°C | 18°C | 14°C |
| 16 | 1 | 3 | " | −19 | −20 | −21 | −23 | −24 |
| 17 | 1 | 2 | " | 36 | 38 | 37 | 35 | 35 |
| 18 | 1 | 4 | " | −13 | −14 | −13 | −15 | −16 |
| 19 | 2 | 5 | " | 23 | 25 | 24 | 23 | 22 |
| 20 | 2 | 6 | " | −16 | −18 | −17 | −19 | −19 |

Table 4-continued

| Test No. | Production Example No. | Compound No. | Mineral oil | Solubility (°C), Addition amount (%) 10% | 20% | 30% | 40% | 50% |
|---|---|---|---|---|---|---|---|---|
| 21 | 3 | 7 | " | 14 | 17 | 16 | 17 | 16 |
| 22 | 3 | 8 | " | −21 | −22 | −24 | −23 | −25 |
| 23 | 4 | 9 | " | 18 | 17 | 17 | 16 | 16 |
| 24 | 4 | 10 | " | −13 | −12 | −11 | −12 | −14 |
| 25 | 5 | 11 | " | −11 | −12 | −13 | −13 | −13 |
| 26 | 5 | 13 | " | −20 | −21 | −23 | −24 | −26 |
| 27 | 5 | 12 | " | −8 | −7 | −8 | −9 | −9 |
| 28 | 5 | 14 | " | −16 | −17 | −17 | −17 | −18 |
| 29 | 3 | 9 | B | 37 | 39 | 39 | 38 | 37 |
| 30 | 3 | 10 | " | −8 | −7 | −6 | −6 | −8 |
| 31 | 5 | 11 | " | −5 | −6 | −6 | −6 | −6 |
| 32 | 5 | 13 | " | −13 | −12 | −12 | −12 | −13 |
| 33 | 5 | 12 | " | −1 | −2 | −2 | −3 | −3 |
| 34 | 5 | 14 | " | −10 | −9 | −8 | −8 | −9 |
| 35 | 1 | 1 | C | 18 | 19 | 20 | 19 | 18 |
| 36 | 1 | 3 | " | −15 | −14 | −14 | −15 | −15 |
| 37 | 1 | 2 | " | 40 | 41 | 41 | 40 | 38 |
| 38 | 1 | 4 | " | −18 | −19 | −19 | −19 | −17 |
| 39 | 2 | 5 | " | 29 | 30 | 30 | 29 | 28 |
| 40 | 2 | 6 | " | −11 | −12 | −10 | −10 | −11 |
| 41 | 3 | 7 | " | 19 | 21 | 20 | 20 | 18 |
| 42 | 3 | 8 | " | −15 | −13 | −12 | −12 | −14 |
| 43 | 4 | 9 | " | 23 | 24 | 24 | 22 | 21 |
| 44 | 4 | 10 | " | −10 | −8 | −7 | −8 | −11 |
| 45 | 5 | 12 | " | −7 | −5 | −5 | −6 | −7 |
| 46 | 5 | 14 | " | −14 | −15 | −13 | −13 | −15 |

The polyoxyalkylene glycol diethers (Compound Nos. 3, 4, 6, 8, 10, 13 and 14) according to the present invention are superior to the control compounds (Compound Nos. 1, 2, 5, 7, 9, 11 and 12) in the solubility in mineral oil. Moreover, as the degree of addition polymerization of PO and BO is lower, the carbon number of the alkyl radicals in both terminals is larger and the addition mole ratio of BO to PO is larger, the solubility in mineral oil becomes higher.

Example 2

The compounds shown in the following Table 5, which were obtained in the above production examples, were added to the mineral oils in the amounts as shown in Table 5, and the viscosity index of the resulting lubricating oil compositions was measured according to JIS K-2284-1961 (K-2284-1966, "A" method). Table 5 shows the viscosity index of the lubricating oil compositions together with that of the compounds.

The test was made as follows.

A 63 type supersonic shear stability tester (made by Toyo Riko Seisakusho) having a standard output of 150 W, a frequency of 10 Kc and an amplitude of 15.5 $\mu$ is used. A compound to be tested is added to a mineral oil in an amount of 5% based on the oil to prepare a test sample. The test sample was kept at 37.78°±2.0°C, and a supersonic wave is irradiated to the test sample to measure the viscosity (cst) at 100°F (37.78°C). The percentage (L) of decreasing viscosity of the test sample was calculated from the following formula according to ASTM-D2603-67T.

$$L = \frac{V_o - V_t}{V_o} \times 100 .$$

In the formula, $V_o$: Kinematic viscosity of the test sample before the irradiation.

Table 5

| Test No. | Production Example No. | Compound No. | VI of compound | Mineral oil | VI of lubricating oil composition, Addition amount (%) 0% | 10% | 20% | 30% | 40% | 50% |
|---|---|---|---|---|---|---|---|---|---|---|
| 47 | 1 | 3 | 147.5 | A | 71.5 | 101.0 | 127.5 | 148.0 | 153.5 | 151.5 |
| 48 | 1 | 4 | 135.5 | " | " | 137.5 | 188.0 | 198.5 | 201.5 | 179.6 |
| 49 | 2 | 6 | 134.0 | " | " | 136.0 | 189.5 | 207.0 | 199.5 | 181.5 |
| 50 | 3 | 8 | 133.0 | " | " | 123.0 | 167.5 | 183.5 | 169.0 | 156.0 |
| 51 | 4 | 10 | 131.0 | " | " | 125.5 | 163.5 | 182.5 | 170.0 | 156.5 |
| 52 | 5 | 13 | 126.5 | " | " | 121.6 | 163.5 | 180.0 | 167.5 | 151.0 |
| 53 | 5 | 14 | 125.5 | " | " | 136.0 | 185.5 | 199.5 | 193.0 | 174.0 |
| 54 | 3 | 8 | 133.0 | B | 108.5 | 113.5 | 135.0 | 139.0 | 141.5 | 135.0 |
| 55 | 5 | 13 | 126.5 | " | " | 111.0 | 131.5 | 137.5 | 140.0 | 136.5 |
| 56 | 5 | 14 | 125.5 | " | " | 116.0 | 138.5 | 142.5 | 144.0 | 139.0 |
| 57 | 1 | 4 | 135.5 | C | 21.5 | 65.0 | 125.0 | 131.0 | 136.5 | 136.0 |
| 58 | 2 | 6 | 134.0 | " | " | 63.5 | 124.5 | 133.0 | 137.0 | 136.5 |
| 59 | 3 | 8 | 133.0 | " | " | 63.0 | 126.5 | 133.5 | 138.5 | 136.5 |
| 60 | 4 | 10 | 131.0 | " | " | 64.5 | 125.5 | 132.5 | 135.5 | 135.5 |
| 61 | 5 | 14 | 125.5 | " | " | 65.5 | 126.5 | 134.0 | 135.0 | 130.0 |

Example 3

The compounds shown in the following Table 7, which were obtained in the production examples, were tested with respect to the shear stability.

$V_t$: Kinematic viscosity of the test sample after the irradiation.

For comparison, polymethacrylate (in the form of a 50% solution is paraffin type mineral oil) (Compound Nos. 62 and 63) and polybutene (Compound Nos. 64 and 65) having the properties as shown in the following Table 6 were used in the shear stability test.

Table 6

| Compound No. | Compound used in comparison test | Specific gravity ($d_4^{15}$) | Average molecular weight | Viscosity (cst) 210°F | 100°F |
|---|---|---|---|---|---|
| 62 | Polymethacrylate | 0.900 | 15,000 | 1,050 | 12,200 |
| 63 | " | 0.901 | 20,000 | 2,010 | 23,500 |
| 64 | Polybutene | 0.890 | 940 | 234 | 8,870 |
| 65 | " | 0.896 | 1,250 | 660 | 27,100 |

Table 7 shows the shear stability. The smaller the percentage of decreasing viscosity, the more excellent the shear stability is. In Table 7, the term "V" shows the viscosity (cst) at 100°F.

Table 7

| Test No. | Compound No. | Production Example No. | Mineral oil | Term | Irradiation time (min.) 0 | 5 | 10 | 20 | 30 | 60 |
|---|---|---|---|---|---|---|---|---|---|---|
| 66 | 4 | 1 | A | V | 15.8 | 15.8 | 15.8 | 15.8 | 15.8 | 15.8 |
| | | | | L | 0 | 0 | 0 | 0 | 0 | 0 |
| 67 | 6 | 2 | A | V | 16.3 | 16.3 | 16.3 | 16.3 | 16.3 | 16.3 |
| | | | | L | 0 | 0 | 0 | 0 | 0 | 0 |
| 68 | 62 | — | A | V | 20.9 | 20.83 | 20.62 | 20.63 | 18.91 | 18.50 |
| | | | | L | 0 | 0.57 | 2.31 | 7.05 | 9.50 | 12.50 |
| 69 | 64 | — | A | V | 19.7 | 19.63 | 19.61 | 19.60 | 19.50 | 19.48 |
| | | | | L | 0 | 0.31 | 0.48 | 0.51 | 0.99 | 1.21 |
| 70 | 13 | 5 | B | V | 41.8 | 41.8 | 41.8 | 41.8 | 41.8 | 41.8 |
| | | | | L | 0 | 0 | 0 | 0 | 0 | 0 |
| 71 | 14 | 5 | B | V | 43.1 | 43.1 | 43.1 | 43.1 | 43.1 | 43.0 |
| | | | | L | 0 | 0 | 0 | 0 | 0 | 0.23 |
| 72 | 8 | 3 | C | V | 288.5 | 288.5 | 288.5 | 288.5 | 288.5 | 288.4 |
| | | | | L | 0 | 0 | 0 | 0 | 0 | 0.03 |
| 73 | 10 | 4 | C | V | 292.1 | 292.1 | 292.1 | 292.1 | 292.1 | 292.0 |
| | | | | L | 0 | 0 | 0 | 0 | 0 | 0.03 |
| 74 | 63 | — | C | V | 491.1 | 483.7 | 473.1 | 446.2 | 442.1 | 414.5 |
| | | | | L | 0 | 1.51 | 3.66 | 9.15 | 9.97 | 15.60 |
| 75 | 65 | — | C | V | 387.3 | 386.8 | 385.2 | 383.5 | 383.1 | 381.5 |
| | | | | L | 0 | 0.21 | 0.55 | 0.97 | 1.09 | 1.49 |

What is claimed is:

1. A lubricating oil composition consisting essentially of a lubricating amount of a mineral oil and a viscosity index improving amount of a polyoxyalkylene glycol diether of the formula:

$$[RO-(CH_2\overset{CH_3}{\overset{|}{C}}HO)_a(CH_2-\overset{C_2H_5}{\overset{|}{C}}HO)_b(\overset{CH_3}{\overset{|}{C}}H-\overset{CH_3}{\overset{|}{C}}HO_c]_2CH_2$$

wherein R is a hydrocarbon radical selected from the group consisting of $C_nH_{2n+1}$, $C_nH_{2n-1}$, $C_nH_{2n-3}$ and $C_nH_{2n-5}$, $n$ is an integer of 1–24 and $$n \geqq 6 - 5\,\frac{(b+c)}{a+b+c},$$

$a+b+c$ is an integer in the range of 5–100, and $a$ or $b+c$ may be 0 but $a$, $b$, and $c$ are not 0 at the same time.

2. The lubricating oil composition of claim 1 wherein said polyoxyalkylene glycol diether is added in an amount of 10–50% by weight based on the mineral oil.

* * * * *